US005553673A

United States Patent [19]

Hackman

[11] Patent Number: 5,553,673

[45] Date of Patent: Sep. 10, 1996

[54] MODULAR SELF-CONTAINED PUMP UNIT FOR VEHICLE MOUNTING

[75] Inventor: Scott D. Hackman, New Holland, Pa.

[73] Assignee: Simon Ladder Towers, Inc., Ephrata, Pa.

[21] Appl. No.: 215,681

[22] Filed: Mar. 22, 1994

[51] Int. Cl.[6] ..... A62C 27/00

[52] U.S. Cl. ..... 169/24; 296/197

[58] Field of Search ..... 169/52, 24, 25; 296/35.3, 197, 196; 280/4

[56] References Cited

U.S. PATENT DOCUMENTS

| | | | |
|---|---|---|---|
| 1,287,238 | 12/1918 | Connor | 169/24 |
| 1,463,569 | 7/1923 | Bathrick | 169/24 |
| 2,154,642 | 4/1939 | Smith | 169/24 |
| 2,207,575 | 7/1940 | Boyles et al. | 169/24 |
| 2,804,826 | 9/1957 | Cilker | 103/104 |
| 2,874,786 | 2/1959 | Cilker | 169/24 |
| 3,770,060 | 11/1973 | Forsyth et al. | 169/24 |
| 4,037,664 | 7/1977 | Gibson | 169/15 |
| 4,512,412 | 4/1985 | Campbell | 169/24 |
| 4,593,855 | 6/1986 | Forsyth | 239/74 |
| 4,830,421 | 5/1989 | Hawelka et al. | 296/24.1 |
| 5,368,317 | 11/1994 | McCombs et al. | 280/4 |

FOREIGN PATENT DOCUMENTS

| | | | |
|---|---|---|---|
| 405285235A | 11/1993 | Japan | 169/52 |
| 2158783 | 11/1985 | United Kingdom | 169/24 |

*Primary Examiner*—Gary C. Hoge

*Attorney, Agent, or Firm*—Andrus, Sceales, Starke & Sawall

[57] ABSTRACT

A pump module for a fire truck includes a self-supporting frame structure of rigid frame members with pump mounting beams laterally spaced in accordance with the spacement of the truck chassis rails. The beams are located generally centrally of the frame structure, which fits with an open truck body chamber with the beams aligned with the rails. The beams include a pump mount plates to which the pump is physically attached. The chassis rails are provided with longitudinally spaced mounting plates secured to the sidewalls of the rails and the pump beams and have similarly spaced mounting plates. The plates are connected by vibration isolation mount units each of which includes a t-shaped rubber mount interposed between the mount plates with a head portion therebetween and a stem portion projecting through the chassis plate. Clamping bolts extend through rubber mount and the mount plate brackets, and compress the rubber mount to establish vibrating isolation of the module and thereby the pump. Enclosing side walls on the module including access openings, have pump connectors, control and monitory instrument displays and control elements. The pump module has an upper chamber overlying the pump unit frame for containing monitoring and control elements, pump hoses and like elements. The sidewalls of the module include access panels for access to the pump control and the module mounting units.

17 Claims, 3 Drawing Sheets

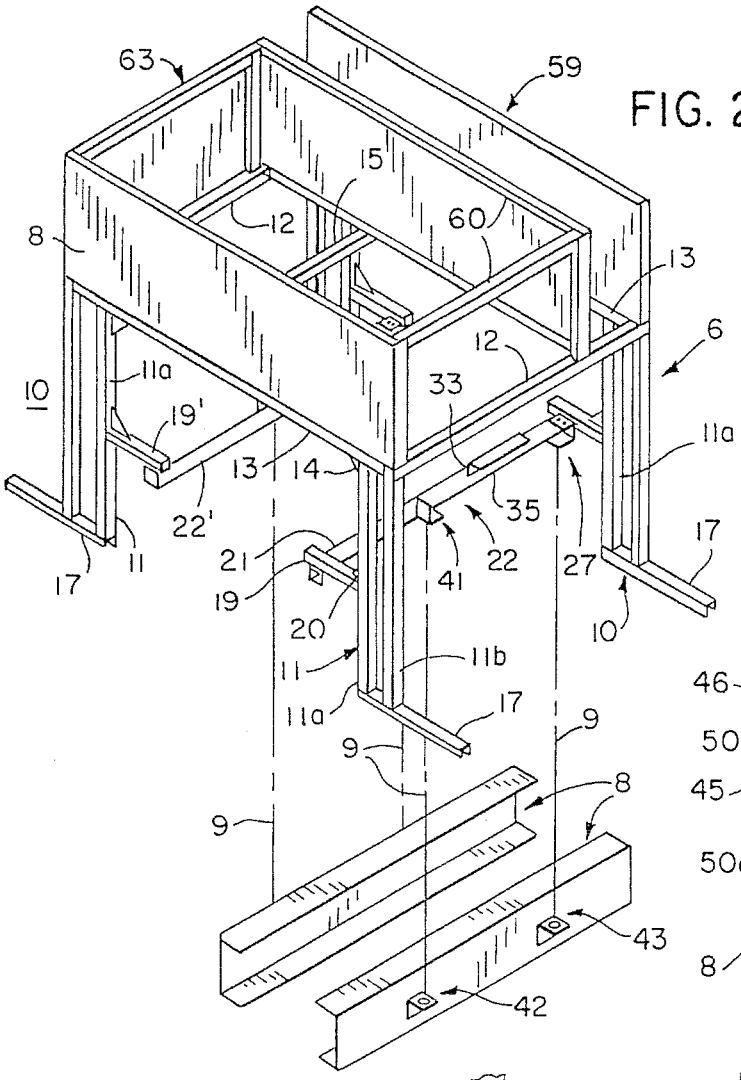
FIG. 2
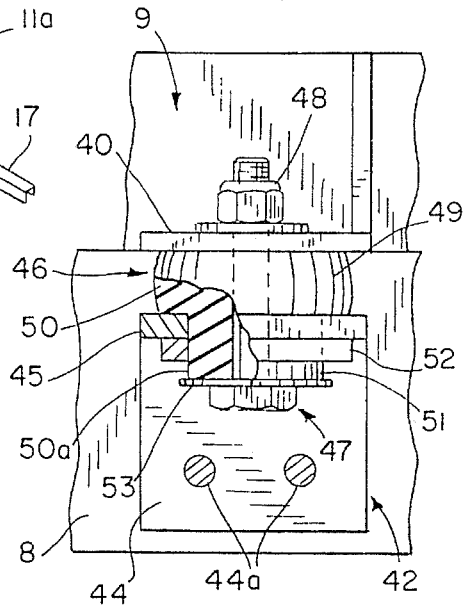
FIG. 6
FIG. 5
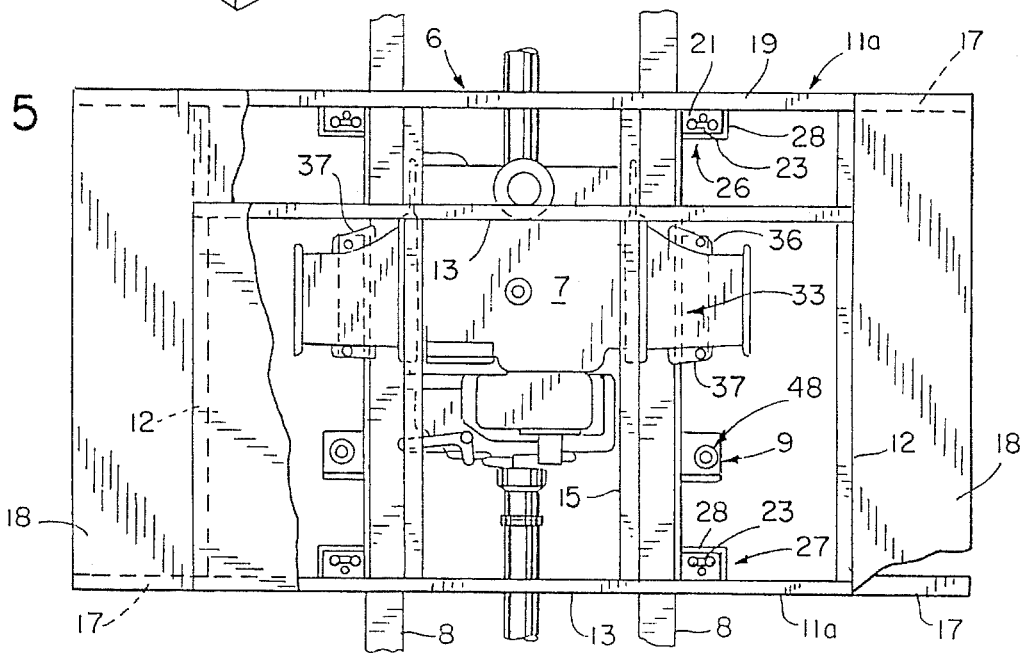

MODULAR SELF-CONTAINED PUMP UNIT FOR VEHICLE MOUNTING

BACKGROUND OF THE INVENTION

The present invention relates to a modular self-contained pump unit for vehicle mounting and particularly to a pump module for releasable attachment into a fire truck for supplying water pumping capabilities upon coupling of a mechanical pump drive to the pump unit.

Modern fire trucks for metropolitan fire fighting units universally include a pumping unit for coupling to a water supply in order to deliver relatively large volumes of water in fighting a fire. The fire truck must be a rugged structural assembly in order to operate over various heavy terrain at relatively high speeds. In addition, the structural stability of the apparatus including the pumping units must be operable under rather severe operating conditions. The pump units used in modern fire vehicles and trucks, such as fire trucks, are generally mounted for in line coupling to a drive from the vehicle engine. It is well known to couple the pump unit to the drive shaft extending from the transmission to the rear wheels. Operating of the vehicle as well as the actual operation of the pump unit for pumping water subjects the assembly to various degrees of vibration.

As a result of the operating factors, the pump units often require periodic maintenance. Because the pump units are relatively large, heavy assemblies, in modern technology and fire trucks, the service and maintenance can be difficult and expensive. Thus, removing of the pump unit may involve a costly procedure because of the size and location of the mechanism. In addition, servicing may be time consuming during which period the fire truck is not available for servicing of fire calls. U.S. Pat. No. 2,804,826 which issued Sept. 3, 1957, for example, discloses a pump assembly particularly adapted for mounting to a fire truck or the like. The pump unit is rigidly mounted to the vehicle frame with a unitized-type construction to permit removal of the impeller section. The remaining parts of the pump assembly remain mounted to the truck frame. This of course does require disassembly of the unit at the truck and provides for only partial service and maintenance.

There is a need to provide a system which reduces maintenance and/or provides a more convenient, less costly and rapid means of effecting maintenance and service of the pump assembly, as well as first assembly to the truck. The system desirably provides for easy and rapid removal and replacement of the pump assembly as such to permit off truck servicing and maintenance.

SUMMARY OF THE PRESENT INVENTION

The present invention is particularly directed to a pump assembly of a modular construction which produces a totally self-contained pumping assembly for mounting and replacement within an appropriate chamber or receiving portion of a truck unit, and preferably requiring only connection and disconnection of the drive power to the modular pump unit for assembly and disassembly of the pump unit from the vehicle. Generally, in accordance with the teaching of the present invention, a self-contained modular unit includes a supporting frame structure defining a totally self-contained pump assembly within which the pump unit is mounted and which merely needs a drive connection for pumping of water through the pump assembly. The pump unit is mounted within the frame structure, with a special vibration isolated mount for coupling to the vehicle frame. The fire truck or other vehicle for receiving of the modular unit is constructed with a special chamber which opens to the truck chassis. The modular unit and the chassis include releasable connectors for mounting of the modular unit to the truck. The connectors include a vibration isolating structure. The modular unit thus includes a vibration mounting to the truck frame for improved isolation of the pump unit from vibration associated with the vehicle movement, as well as damping of the vibration of the unit during transport and operation of the pump unit, thus contributing to the effective and extended life of the pump unit with less maintenance and service requirement. The modular unit includes an outer enclosing cover structure including access openings such that the connectors are excessible directly by removal of a simple outer protective cover of the modular unit. The modular unit is thus mounted directly within such chamber of the vehicle unit with the pump unit located for simple and direct interconnection to the vehicle drive system, and preferably enclosed with the outer removable exterior cover structure.

The modular unit provides for simple assembly and disassembly of the pump unit for servicing and maintenance and permits direct access to the total pump unit when removed.

More particularly, in accordance with a preferred and practical embodiment of the present invention, a pump subassembly or module includes an outer compartment frame structure constructed of suitable rigid and interconnected frame members. The module frame generally is a rectangular compartment opened on the four sides and with rigid frame members at each corner. Pump mounting members with appropriate laterally spaced pump mount brackets are secured within the frame structure. The mount brackets are spaced essentially in accordance with the spacement of the vehicle frame chassis rails, and are located generally centrally of the compartment frame structure. The vehicle body structure includes a lateral opening or open chamber corresponding essentially to the front-to-back length of the pump module. The compartment frame structure is movable into the opening with the pump mount members or bracket in immediately adjacent relationship to the sides of the chassis rails. The outermost portion of the frame structure of the pump module is aligned with the outer enclosure structure of the fire truck, such as the cab and the rear mounted fire fighting mechanism and support.

In assembly, the pump module with the pump mounted therein, is assembled and placed within the pump chamber as a subassembly and affixed to the chassis rails of the truck by vibration isolating units. The vehicle drive line is connected to the mechanical drive of the pump and the pump is mechanically in condition for pumping of water.

The pump module is preferably provided with chambers for housing appropriate monitoring and control elements which are interconnected as part of the pump system, hoses and like elements which are connected to the pump. The enclosure for the pump control system include removable panels for permitting access to the pump control and the pump chassis connection.

More particularly, in a preferred mounting assembly, the chassis rails are provided with longitudinally spaced mounting angles secured to the vertical wall of chassis rails. The pump module includes a pair of laterally spaced mounting channels secured to the modular frame structure. Each channel includes spaced mount brackets located in alignment with the chassis mount angles. Each vibration isolator includes a large resilient element interposed between the mount brackets and angles. The elements in a preferred construction include a head portion between the bracket and elements and a stem portion projecting through the chassis angle. Suitable bolts extend through resilient element and both the chassis mounting angles and the module mounting brackets to create the vibration isolated mounting of the module and particularly the pump unit to the chassis.

The construction of the pump module with an outer welded frame having the compartment mounting and the pump mounting as an integrated weldment provides an effective and practical commercial implementation of this embodiment of the invention. A suitable enclosure for instrumentation and auxiliary equipment may be provided to the top side of the weldment. In a preferred construction, a partial compartment is provided to one end of the module with an opened chamber provided at the opposite end of the module for receipt of auxiliary equipment, such as hoses and the like. This structure provides convenient carrying and access of such equipment to the fire personnel.

The total assembly with the spaced vibration mounts provides an effective and long-life support of the pump unit. The module unit allows convenient high speed manufacture and assembly while maintaining total access to the pump unit. The use of the modular construction also provides very simple removal of the pump unit for service, if required, by merely releasing of the pump compartment mount units secured to the chassis and lifting of the total module upwardly from the chassis upon disconnection of the drive.

BRIEF DESCRIPTION OF THE DRAWINGS

The drawings furnished herewith illustrate the best mode presently contemplated for carrying out the invention and are described hereinafter.

In the drawings:

Fig. 2 is a pictorial view of the pump compartment frame structure with the pump mount elements and more clearly illustrating the pump mounting subassembly.

FIG. 5 is a top enlarged elevational view of the pump module secured to vehicle chassis; and FIG. 6 an enlarged fragmentary view of the rubber isolating mount installation between the pump module and the vehicle chassis.

DESCRIPTION OF THE ILLUSTRATED EMBODIMENT

Figure 1:
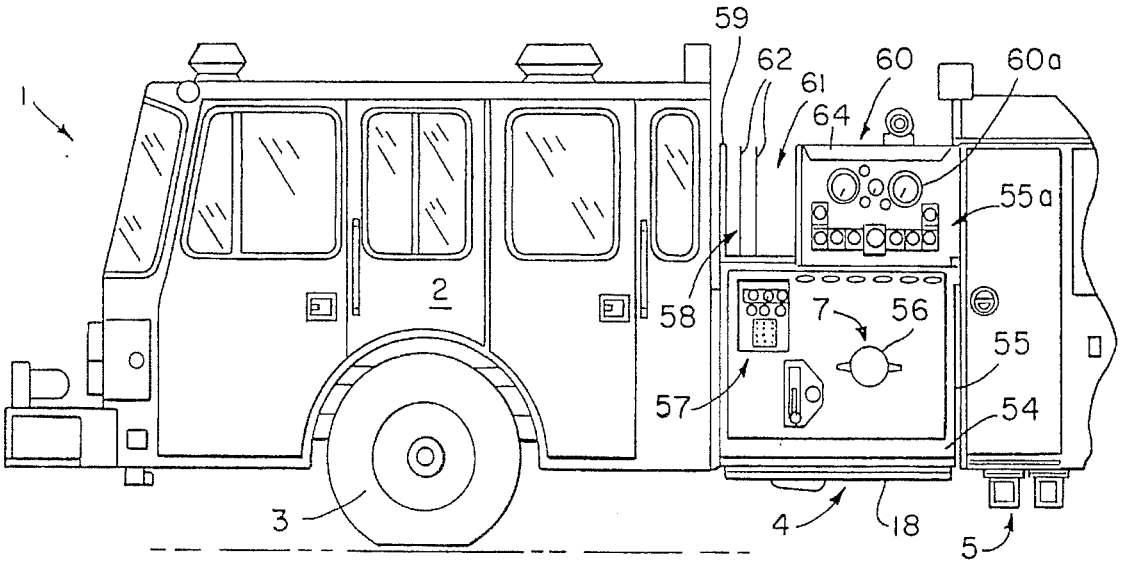
FIG. 1 is a fragmentary side elevational view of a fire truck including a pump enclosure assembly in accordance with the teaching of the present invention.

Referring to the drawings and particularly to FIG. 1, a side elevational view of a forward portion of a fire truck 1 is diagrammatically illustrated. The illustrated fire truck includes a forward cab assembly 2 with appropriate side doors for the vehicle driver, auxiliary firemen and other necessary equipment. The forward end of the vehicle includes the supporting wheels 3 in accordance with conventional construction. A modular pump subassembly particularly defining a pump module 4, is releasably mounted behind the cab 2 and in front of the rear ladder and related structure 5. The modular pump subassembly and module 4 includes its own frame structure 6, shown in FIGS. 3–6, within which a fire pump unit 7 is mounted. The fire pump unit 7 is totally capable of water or like pumping action upon receiving a mechanical input drive. Thus, with the module frame structure secured to the truck structure, and particularly the truck chassis, in a practical embodiment, the pump unit 7 is ready for pumping upon attachment of the mechanical input drive from the engine drive system. In a practical application, the hoses and the control devices are housed within the modular pump subassembly 4 and coupled to control the pump speed and the like, as hereinafter described.

The pump module 4 is mounted for vertical movement with the chamber between the cab 2 and rear structure 5 and is shown connected to the frame rails 8 of the truck chassis, which connection preferably forms the only supporting connection for the module. The mounting of the module frame structure 6 to the chassis rails 8 includes longitudinally spaced vibration isolation mount units 9. Four individual vibration mount units are provided, two to each chassis frame member or rail. The pump unit 7 itself is mounted to a pump mount unit secured as a part of the module, with the pump unit 7 located between the longitudinally spaced vibration mount 9 such that the pump unit 7 is mounted directly for optimum vibration isolation. The modular pump construction is more fully disclosed in FIGS. 2–6, and illustrates a preferred and practical construction.

Referring particularly to FIG. 2, the module frame structure 6 consists of a pump compartment weldment 10 including a plurality of rigid interconnected frame members defining a substantially open rectangular frame structure. The illustrated frame structure includes four corner posts 11, each of which includes laterally spaced rectangular metal box beam members 11*a* and 11*b*. The upper end of the posts are interconnected by longitudinal cross beams 12 and lateral cross beams 13, formed of similar rectangular cross section box beams and interconnected in overlapping relationship to form with the post 11 a top frame and with suitable gusset plates 14, by suitable welded joints. Two additional longitudinal cross braces 15 extend longitudinally along the length of the frame structure generally equally spaced between the cross beams 13. The top frame has a width less than the width of the truck cab 2, with bottom frame members 17 secured to the lower end of each corner post 11 and projecting outwardly from the sides of the frame structure. The outer ends of the in-line bottom frame members 17 are spaced in accordance with the width of the truck cab 2 and support a ledge plates or running boards 18 secured to such frame members. The running boards 18 are rigid plates secured to the side bottom frames members 17 and provide a standing area within the structure of the pump module assembly to either side of the truck.

The inner ends of the bottom braces 17 project inwardly beneath the spaced members 11*a* and 11*b* to define support elements for supporting and locating of the pump mount unit in proper relation to the chassis.

Referring particularly to the construction shown in the right side of FIG. 2, each vertical post member 11*a* is shown welded or otherwise affixed to the top side of member 17 and to the upper frame member 13. Gusset plate 14 is welded at the junction at the members 11*a* and 13. Generally in the center of each post, a frame arm 19 is welded to the vertical frame member 11*a* and projects inwardly therefrom. A gusset plate 20 is secured at the junction of the member 11*a* and arm 19 to strengthen the support of the frame arm. A mounting plate 21 is welded to the underside of the arm 19, at the outer end thereof. The plate 21 projects longitudinally inwardly to define a mounting support for one end of a pump mount weldment or element 22. The opposite end of mount element 22 is similarly supported by a laterally aligned plate 21 at a second arm 19. The plates 21 include a longitudinally extended slot 23 for attachment of the pump mount element 22 to the frame arm 19. A similar structure is provided at each arm 19 and thereby each corner post 11 of the pump compartment frame 6. Similar pump mount weldments 22 are secured to the laterally aligned mount plates 21.

Figure 3:
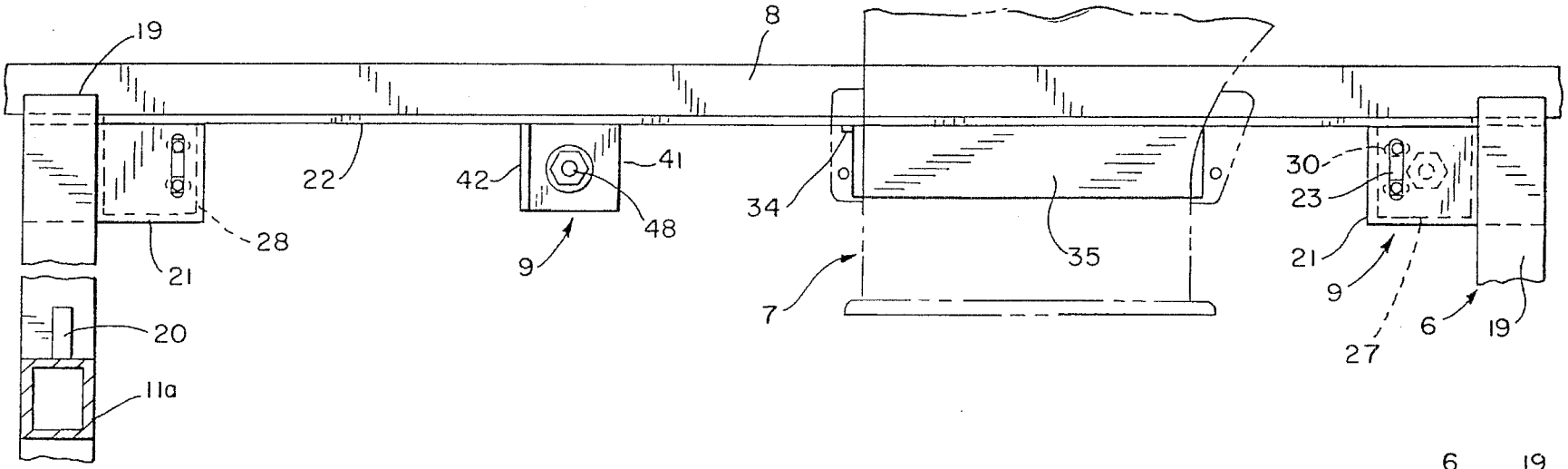
FIG. 3 is a fragmentary top elevational view of a pump mount structure as shown in FIG. 2 with a pump unit mount shown.
Figure 4:
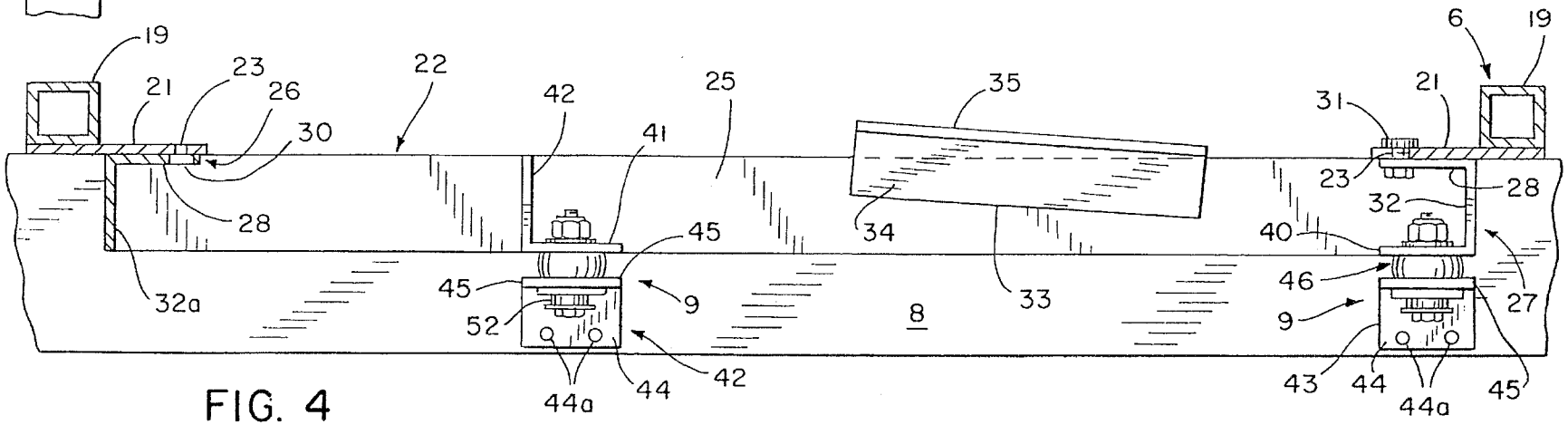
FIG. 4 is a side elevational view of the pump mount structure shown in FIG. 2.

Each pump weldment or element 22 is similarly constructed. Referring to FIGS. 3 and 4, the structure of one weldment is more fully shown. The element 22 includes a vertical support plate 25 with securement end brackets 26 and 27, located at the opposite ends of the plate. The securement end brackets 26 and 27 each include a similar flat plate member 28, respectively, having a pair of elongated slots 30 located for alignment with the longitudinal slot 23 of the mount plate 21. Clamping bolts 31 pass through the slots and rigidly connect the members. The securement end brackets 26 and 27 further include square end plates 32 and 32*a* secured to the end of the vertical plate 25 and the underside of the respective securement end brackets 26 and 27. The plate 32*a* at the one securement end bracket 26 is a triangular shaped bracket having edges secured to the plate 25 and the plate 28. The plate 32 at the opposite end is a substantially square plate similarly secured to the plate 25 and the plate 28.

A pump mounting angle bracket 33 is welded to the inner face of the plate 25, with the mounting located off center and particularly located significantly closer to the rear mounting bracket 27.

An L-shaped angle bracket 33 has a vertical side member 34 welded to the inner side member of the plate 25 and an upper side member or plate 35 projecting inwardly of the module from the plate 25 and thus inwardly between the spaced and aligned brackets 26 and 27. The two pump mount plates 35 (FIG. 5) are located to the opposite sides within the module and project inwardly to receive the pump 7. The pump 7 includes longitudinally spaced mounting pads 36 and 37 (FIGS. 4 and 5) which are laterally aligned with and attached to the mounting angles 35 in any suitable manner. The pump mount angle bracket 33 is angularly oriented with a raised front, as shown in FIG. 5, in accordance with the necessary mounting and alignment of the pump unit 7 for connection as such to the vehicle drive system 39.

Chassis mount plates 40 and 41 (FIGS. 3 and 4) are secured to the lower edge of the vertical plate 25. The one mount plate 40 is secured as by welding to the trailing or rearward end of the support plate 25 and the square securement end plate 32 of end mount bracket 27. The second mount plate 41 is secured to the support plate 25 on the opposite side of the mount angle bracket 33. The mount bracket 41 is again a flat plate having appropriate bolt openings and with the strengthening plate 42 of a square configuration welded in abutting relation to the plate 25 and mount plate 41. The securement end brackets 26 and 27 are longitudinally spaced for attachment to the rails 8, and particularly to longitudinally spaced brackets 42 and 43, shown as L-shaped members.

Each bracket 42 and 43 is an L-shaped angle member having a vertical side leg 44 bolted or otherwise rigidly secured to the vertical wall of the chassis rail 8, as by bolts 44*a*. The module mount walls or legs 45 of the L-shaped angles 42 and 43 project laterally outwardly. The legs 45 are aligned with the mount plates 40 and 41 of the securement end brackets 26 and 27 and are connected by electrical vibration isolating couplings 46 forming the only illustrated mounting of the pump subassembly.

One of the vibration mount couplings 46 is more clearly shown in FIG. 6. The module mount coupling includes a suitable headed bolt 47 extended through aligned openings in the plate 40, the coupling 46 and the leg 45. An elastic hex nut 48 is secured to the upper end of the bolt 47. The vibrating isolating coupling 46 includes a resilient mount member 49 interposed between the plate 40 and the leg 45 with the bolt 47 tightened to compress the member. The illustrated resilient mount 49 is generally a round rubber member having a T-shaped cross section. The member 49 has a cross bar portion 50 and depending stem portion 50*a* with the portion 50 interposed between plate 40 and leg 45. The leg 45 is a plate member having an enlarged bolt opening 51 to receive a stem portion 50*a* of the resilient mount member 49. Leg 45 includes an added bottom plate 52 to enlarge the length of the coupling bolt opening 51. The stem portion 50*a* of resilient member 49 has a length greater than opening 51 and an unstressed diameter slightly less than the diameter of the opening 51 in the chassis mounting leg 45. A rubber mount washer 53 is interposed between the hex head bolt 47 and outer end of stem 50*a* of member 49. Upon drawing of the bolt 47 onto the assembly, the rubber mount member 49 expands laterally within said opening 51 and between the chassis mount leg 45 and the mount plate 40. The compressed rubber member establishes effective isolation of the module against truck related vibrations.

The pump module 4 is thereby secured to each of the chassis rails 8, and in the illustrated embodiment, forms the sole mounting attachment of the module 4 to the truck chassis. The module 4 thus defines a separate self-contained sub-assembly which can be lifted into position for direct isolated mounting to the chassis of the truck. The input drive member of the pump unit 7 is connected directly to the vehicle drive train and the pump unit is mechanically in condition for pumping. The punch module 4 can be raised or lowered into the space or chamber between the cab 2 and the rear truck-mounted structure 5, and thus provide a total modular construction for assembly and disassembly of the pump unit for maintenance and service.

The side of the module frame structure 6 is closed by suitable sidewalls. The opposite outer sidewalls 54 (FIG. 1) include access panels 55 for access to the pump assembly and the interconnection to the chassis coupling 46 of the mechanical drive connection. The access panels 55 also each include fire pump connectors 56 for connecting of the water supply hose and an outlet hose to the pump unit 7. The panels may also support certain control and monitor units as shown as 57, which are interconnected to the pump unit for on-line control of the pumping.

Other necessary monitoring devices and auxiliary equipment, such as hoses and the like, are also provided directly within the modular construction, in the illustrated embodiment of the invention. As shown in FIGS. 1 and 2, the top frame members 12 of the module frame structure are located generally centrally of the vertical height of the cab 2. An upper compartmental housing unit 58 is secured to the upper end of the module frame structure and consists of an end vertical wall 59 which is located adjacent to the front end of the module 4, and projects upwardly from the pump enclosure. A separate housing 60 is secured in rearwardly spaced relation to the wall 59 to define an open compartment 61 within which hoses and other auxiliary equipment are readily placed and stored for ready and convenient access and use. The compartment 61 may include movable dividers 62 for defining subchambers therein. The housing 60 defines a rear enclosure for receiving of control and monitoring equipment and the like, as shown at 60*a*. Such equipment and controls are not illustrated as they would be readily provided in accordance with conventional construction. Generally, the housing 60 includes a separate upper frame structure 63 secured to the top frame braces. Suitable outer wall panels are provided along each side to provide an appropriate sealed weather-tight enclosure. A top wall (not shown) is pivotally secured to the housing frame 63 and provides an access opening for entrance into the housing to provide and service the various instruments and the interconnections within the pump operational systems.

In practice, the pump unit 7 is secured within the enclosure frame to form a subassembly. The pump module 4 is then lifted into position and installed to the truck using the vibration mount couplings 46. The vehicle drive is connected to the pump unit 7 and the necessary control and monitoring instrumentation connections are completed to make the pump operational. If it is necessary to remove the pump module, the pump enclosing access panels 55 are removed, and the drive connection to the pump unit 7 is disconnected. The top cover 64 of housing 60 is opened permitting direct access to the cross beam structure of the pump compartment frame 6. A suitable lift mechanism, not shown, is mounted in overlying relation to the module 4 and interconnected through suitable hoist chains or the like for lifting of the released module directly upwardly from the truck chassis.

The pump unit 7 itself is of a standard construction. Thus, in a practical application, a typical pump unit sold by Waterous Company of South St. Paul, Minn. has been used, including a pump unit with a depending gear drive with an input shaft adapted to be coupled in line from the engine drive shaft directly from the vehicle drive system. The pump unit is adapted to be mounting extending across the chassis rails 8 with the inlet to one side and the outlet side to the opposite side of the chassis. The spaced mounting pads 36 and 37 are provided to the opposite sides or ends of the pump housings for the alignment to the outside of the chassis rails. The pads are aligned and attached to the mounting angles to locate the fire pump structure as such generally in center alignment of the side frame walls or openings. The connecting drive shaft is generally a spline shaft which extends forwardly and is connected to the usual transmission system, not shown, of the fire truck.

The mounting pads 36 and 37 are secured to the underside of the inlet castings for mounting of the pump unit onto mount angle brackets 33 and thereby in fixed relationship within the pump compartment frame to form a total mechanical subassembly and module for placement to the truck chassis.

Various modes of carrying out the invention are contemplated as being within the scope of the following claims particularly pointing out and distinctly claiming the subject matter which is regarded as the invention.

I claim:

1. A mobile fire fighting apparatus for over-the-road travel, comprising a wheeled support structure having laterally spaced chassis rails with a mechanically driven power unit located therebetween, a vehicle drive structure secured to a first portion of the support structure, fire fighting equipment secured to a second portion of the support structure, a pump module secured to a third portion of the structure, said pump module comprising a rigid frame structure including a front wall structure, a back wall structure and first and second side wall structures connecting the opposite side edges of said front wall and said back wall, said pump module including a pump mount support secured as an integrated part within said rigid frame structure, said pump mount support having mount elements laterally spaced in accordance with the chassis rails of said vehicle, each of said rails having chassis mount elements rigidly secured to the rail, said chassis mount elements on said chassis rails being spaced in accordance with the pump mount elements of said pump mount support and in alignment with said pump mount elements, and connectors including vibration isolating coupling members interconnecting said aligned mount elements, said connectors being releasable and forming the primary physical interconnection of said pump module to said vehicle chassis, and whereby said pump module is mounted to said chassis as a self-contained pumping unit and is removable from said chassis as a self-contained pumping unit.

2. The apparatus of claim 1 wherein said pump mount support includes laterally spaced mount beam members connected between said front wall structure and said back wall structure, said beam members having said pump mount elements between said side walls into alignment with said chassis mount elements.

3. A fire truck comprising a wheeled vehicle having a personnel cab portion and a spaced ladder and equipment portion with a chamber therebetween, said chamber having an open bottom aligned with exposed laterally spaced chassis rails of said vehicle, said vehicle having a vehicle drive system between said chassis rails, a pump module including a rigid housing structure adapted to fit within said chamber and having an opened bottom aligned with said chassis rails and adapted to be vertically moved downwardly into said chamber and over said chassis rails, a rigid pump support structure within said housing structure and said pump support structure including a releasable pump mount assembly spaced in accordance with said rails, a pump unit secured to said pump support structure, and connectors releasably securing the pump mount assembly to said rails, said connectors including vibration isolating units to establish vibration isolation between said pump module and said chassis rails, said pump module with said pump unit secured to said pump support structure forming a subassembly for direct connection to said chassis rails and permitting complete removal of said subassembly from said rails with said pump unit secured in place, said pump unit having a mechanical input adapted to be connected to said vehicle drive system and to thereby establish a pumping action.

4. The fire truck of claim 3 wherein said pump mount assembly includes at least a first and second pump support member aligned with said first rail and third and fourth pump support members aligned with said second rail, said rails having support elements aligned with said support members, and said connectors of said vibration isolating units including separate releasable couplings interconnecting each of said support elements and said support members to establish said releasable mount of said module to said rails.

5. The fire truck of claim 3, wherein said chassis rails each include a mounting angle member rigidly affixed to the chassis rail, each angle member including a substantially horizontal mount leg projecting generally perpendicular from the chassis rail, said mount leg including an extended opening, a rubber mount having a first portion abutting said leg and an integral extending portion extending downwardly through said opening in said leg, said pump mount assembly including a rigid mount plate member resting on said rubber mount and said leg, a clamping unit compressing said rubber mount between said leg and said plate member to thereby compress said rubber mount and establish a vibrational support substantially isolating said pump module from said chassis.

6. The fire truck of claim 5, wherein said clamping unit includes a bolt member extended through said rubber mount and said plate.

7. The fire truck of claim 5, wherein said rubber mount is generally a round member having a T-shaped cross section including a stem portion of a diameter slightly less than the diameter of the opening in said leg and a cross bar portion having a diameter greater than the opening and less than the width of the leg.

8. The fire truck of claim 5, wherein said rubber mount extends downwardly through an opening in the mounting angle member and wherein said rubber mount expands outwardly of said opening in said mount leg and between said mounting leg and said mount plate of said mounting angle member.

9. A modular pump module for supporting a pump unit and adapted to be releasably interconnected within a chamber behind the cab structure of a fire truck, said chamber being open on the top and on the opposite sides of the fire truck and with chassis rails of said truck exposed within a bottom opening of said chamber, said pump module comprising a compartment frame including four corner posts interconnected to each other by a rectangular upper frame member, said compartment frame having a lateral width slightly less than the lateral extent of said chamber between the opposite sides of the fire truck and greater than the lateral spacing of said chassis rails, said frame having bottom frame members connected to each corner post, and each bottom frame member extending outwardly from the corner posts with the spacement between the outer ends of said bottom frame members being substantially equal to the lateral width of said chamber, a pump mount arm connected to each of said corner posts and projecting laterally inwardly from its respective corner towards the opposite respective corner post and terminating substantially in spaced relation to its respective opposite pump arm in accordance with the spacing of said chassis rails, a pump mount beam member extending longitudinally between the longitudinally spaced pump mount arms and including a pump mounting angle for interconnection of a pump unit thereto compartment frame mount members rigidly affixed to and projecting from said pump mount beam members and spaced in accordance with said chassis rails for alignment with the chassis rails, a plurality of chassis mount members adapted to be secured to said chassis rails in spaced relation to each other and precisely corresponding to the spaced relation of the compartment frame mount members, said compartment frame located within said chamber with said compartment mount members aligned with said chassis mount members, a plurality of rubber isolating coupling units each including a rubber mount interposed between said aligned compartment mount members and chassis mount members and an elongated clamping member extending through the aligned members and said rubber mount and compressing said rubber mount to establish a rubber isolating interconnection of the pump module to said chassis rails and essentially establishing the sole interconnection of said compartment frame to said truck chassis whereby said compartment frame is adapted to be assembled with said pump unit to form a subassembly which is directly mountable and removable from said chassis rails by releasing of said elongated clamping members and lifting said pump compartment frame upwardly from said chamber.

10. The modular pump module of claim 9 wherein said compartment frame chassis and mount members each being plate-like elements having aligned openings to receive said clamping member, the opening in each said chassis mount member being substantially wider and longer than the opening in said compartment frame mount member, said rubber mount having a first portion located between said plate-like elements and a second integral portion extended through said opening in said compartment frame mount member.

11. The modular pump module of claim 9, wherein said corner posts and said upper frame member are adapted to be located substantially below the level of the cab structure of said truck, an upper housing assembly secured to said upper frame member and projecting upwardly therefrom to define a housing for containing pump instrumentation.

12. The modular pump module of claim 11, wherein said upper housing assembly includes a laterally extended opening throughout the width said upper housing assembly and defining an open chamber for supporting of a hose adapted to be coupled directly to the pump unit.

13. The modular pump module of claim 9, including pump hose connectors at the opposite sides of said compartment frame, and support members extending longitudinally between the longitudinally spaced bottom frame member and defining running boards adjacent said pump hose connectors.

14. A modular pump module for releasable interconnection within a chamber between a cab structure and a fire equipment structure of a fire truck, said chamber having an open top and open sides and an open bottom with chassis rails of said truck exposed within said open bottom, said pump module comprising a self-supporting frame structure having first and second elongated pump-mount elements spaced in accordance with said chassis rails, said pump mount elements being located generally centrally of said self,supporting frame structure and with said frame structure extending above and below said chassis rails in the assembled position, vibration isolating couplings connected to said pump mount elements and adapted to be connected to said chassis rails, and each of said couplings including aligned first and second plate-like members secured respectively to said chassis rail and said pump mount element, a resilient member interposed between said aligned plate-like members, and a clamping unit connected to said plate-like members and compressing said resilient member therebetween to attach said frame structure to said chassis rails.

15. The modular pump module unit of claim 14, wherein said first plate-like member adapted to be secured to said chassis rail is located below said second plate-like member, said plate-like members having aligned openings, said resilient member is a rubber member having an opening aligned with said aligned openings and having a first portion located between said plate-like members and an integral second stem portion extending downwardly through said aligned opening in said lower plate-like member, said clamping unit including a clamping member extended through the aligned openings and compressing said rubber member between said plate-like members to thereby compress said first and second portions of said rubber member and establish a vibrational support substantially isolating said pump module from said chassis.

16. The pump unit of claim 15, wherein said clamping member includes a head bolt member having a head and clamping nut with washers located abutting the head and the clamping nut.

17. In the apparatus of claim 15, wherein said rubber member is generally a round member and said stem portion has a diameter slightly less than the diameter of the opening in said lower plate-like member and wherein said rubber member expands outwardly to fill said opening.

* * * * *